US005643023A

United States Patent [19]

Sober

[11] Patent Number: 5,643,023

[45] Date of Patent: Jul. 1, 1997

[54] MARINE ENGINE GEAR CASE COVER

[76] Inventor: Joe Sober, P.O. Box 90891, Austin, Tex. 78709-0891

[21] Appl. No.: 628,402

[22] Filed: Apr. 5, 1996

Related U.S. Application Data

[63] Continuation of Ser. No. 70,502, Jun. 2, 1993, abandoned, which is a continuation of Ser. No. 831,405, Feb. 5, 1992, abandoned.

[51] Int. Cl.[6] ..... B63H 21/00

[52] U.S. Cl. ..... 440/76; 440/900

[58] Field of Search ..... 440/66, 70, 71, 440/72, 900, 78, 76

[56] References Cited

U.S. PATENT DOCUMENTS

| | | | |
|---|---|---|---|
| 2,081,868 | 5/1937 | Hampden | 114/274 |
| 3,099,240 | 7/1963 | Montague, Jr. | 440/71 |
| 3,885,517 | 5/1975 | Borst et al. | 440/61 |
| 3,939,795 | 2/1976 | Rocka | 440/78 |
| 4,597,742 | 7/1986 | Finkl | 440/71 |
| 5,007,869 | 4/1991 | Zoellner | 440/900 X |
| 5,178,565 | 1/1993 | Jacobson | 440/71 |
| 5,224,889 | 7/1993 | Hickey | 440/71 |

FOREIGN PATENT DOCUMENTS

| | | | |
|---|---|---|---|
| 131690 | 11/1978 | Japan | 440/78 |

*Primary Examiner*—Edwin L. Swinehart

*Attorney, Agent, or Firm*—Donald R. Comuzzi; Christopher L. Makay

[57] ABSTRACT

The present invention is a skeg cover which may be fitted onto either a damaged skeg or a new skeg to prevent shaft, gear, or propeller damage. The present invention is constructed such that it is inexpensive and may be quickly and easily installed by a boat owner.

4 Claims, 1 Drawing Sheet

MARINE ENGINE GEAR CASE COVER

This is a continuation of application Ser. No. 08/070,502 filed Jun. 2, 1993, which is a continuation of application Ser. No. 07/831,405 filed on Feb. 5, 1992, both now abandoned.

BACKGROUND OF THE INVENTION

The present invention relates to an apparatus used to repair a worn or broken lower unit housing on a marine engine or re-enforce and protect a new one.

Conventional marine engines, including both outboard and stern driven, have a gear case which is part of the lower housing unit. This gear case serves two purposes. It covers and protects the gears and it deflects objects in the water around the lower unit to prevent shaft, gear or propeller damage. This lower unit housing also extends below the propeller to prevent the propeller from striking bottom when the boat is used in shallow water, thereby preventing propeller damage or damage to the gears. The lower housing is made of cast aluminum and while it is adequate to prevent lower unit damage, it will after continued use become damaged itself or worn down as shown in FIG. 2. Once the housing has been damaged, it must be repaired or replaced. This lower housing is referred to in the art as a skeg.

Presently, there are two methods of repairing the skeg. The first method entails replacing the entire lower unit housing cover. Because the skeg is but a small part of the entire lower unit, replacing the entire lower unit cover is both expensive and extremely wasteful. If the damage to the skeg cover is slight, the second method of welding a piece of suitable metal, normally cast aluminum, to the lower unit housing may be employed. In that method, the damaged section is first removed with a clean cut and a new piece is attached by welding. The new piece is then sanded and shaped to its original form. Unfortunately, the welding of cast aluminum is also expensive. Additionally, the work must be performed by a skilled welder who is not normally available in the average marine repair shop.

Accordingly, the present invention has been developed to provide a quick, easy and inexpensive cover which may be mounted over new skegs to prevent their damage or over old ones to repair them.

SUMMARY OF THE INVENTION

The present invention is a cover assembly constructed such that it may be filled with a suitable bonding material such as epoxy and mounted over a new or existing skeg to repair or protect the skeg.

Therefore, it is an object of the present invention to provide a skeg cover that is inexpensive and one that may be quickly and easily installed.

It is also an object of the present invention to provide a skeg cover that may be used to re-enforce and protect a new skeg or repair a broken skeg.

It is a further object of the present invention to provide a skeg cover that helps prevent propeller damage.

It is still a further object of the present invention to provide a skeg cover that helps prevent shaft and gear damage.

It is even a further object of the present invention to provide the skeg with a hydro-deflector skid plate which is designed to act as both a reinforcing means for the skeg cover as well as a deflector plate to deflect debris downwardly away from the propeller.

Still other features and advantages of the present invention will become evident to those skilled in the art in light of the following brief description of the drawings and detailed description of the preferred embodiment.

DETAILED DESCRIPTION OF THE PREFERRED EMBODIMENT

Figure 1:
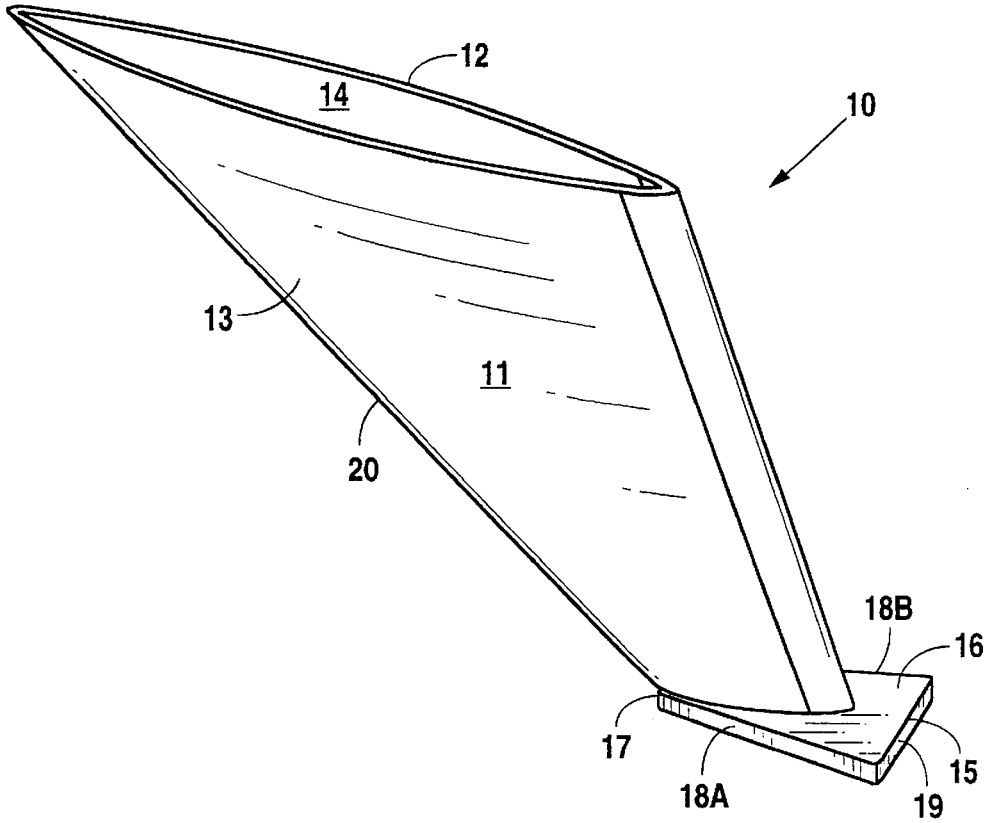
FIG. 1 is a perspective view showing the skeg cover of the preferred embodiment of the present invention.

Referring to FIG. 1, the skeg cover of the preferred embodiment of the present invention will be described.

Skeg cover 10 comprises sheet 11 which is bent about centerline 19 forming centerline 20 and sealed at its open end to form a first wall 12 and second wall 13 defining top and bottom openings therebetween. The bottom opening is then sealed to a skid plate 15 to form a pocket 14. The skid plate 15 at its top surface 16 includes sides 16, 17 and rear end 18. Skid plate 15 is larger than the skid plate normally found on marine motors and is made of much stronger material to enhance its deflection capability and provide additional strength to the skeg cover.

Skid plate 15 is formed in the shape of a triangle, two side portions 18A and B are joined forwardly at apex 17 and extend rearwardly along the sides of first wall 12 and second wall 13 beyond cover 10 where they are connected together by third side portion 19. Skid plate 15 resides in a substantially horizontal plane and has a size which is approximately twice that of the bottom opening. Furthermore, it should be apparent to one skilled in the art that the triangular shape of skid plate 15 provides apex 17 which cuts a path through the water without generating excessive turbulence.

In the preferred embodiment, sheet 11 and skid plate 15 are formed of high nickel stainless steel. However, one of ordinary skill in the art will readily recognize that any suitable material could be used to form skeg cover 10 such as a plastic material, and that any means of sealing metal could be substituted.

Figure 2:
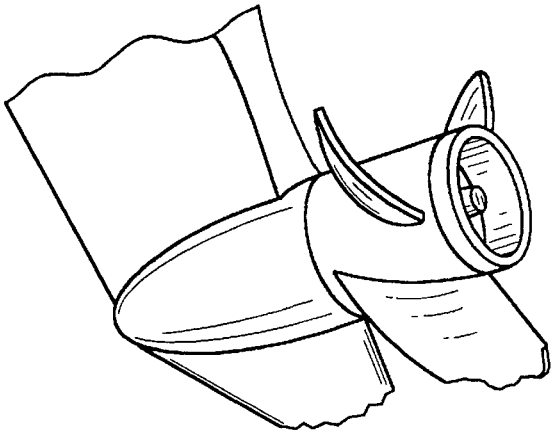
FIG. 2 is a perspective view of a lower unit having a damaged skeg.
Figure 3:
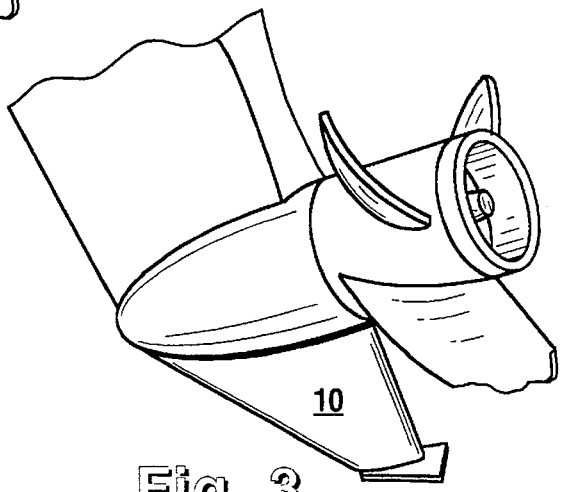
FIG. 3 is a perspective view of a lower unit showing the skeg cover of the preferred embodiment of the present invention installed.

Referring to FIGS. 2 and 3, the use of skeg cover 10 will be described.

FIG. 2 shows a lower unit which has a damaged skeg. Presently, either the entire lower unit housing must be replaced or the skeg is repaired with a new piece of material welded thereto. Skeg cover 10 of the present invention is used to repair the broken skeg shown in FIG. 2 as follows. First, the pocket 14 of skeg cover 10 is filled with epoxy or any other suitable bonding material. Second, skeg cover 10 is slipped over the damaged skeg and the bonding material is allowed to dry. Once the epoxy has hardened, skeg cover 10 is permanently affixed and will function better than the original skeg (See FIG. 3). Additionally, skeg cover 10 may be fitted over new skegs in order to protect them from future damage since the skeg cover is made of stronger material and has a longer skid plate than the original skeg design.

From the foregoing description and illustration of this invention, it is apparent that various modifications may be made by reconfigurations or combinations to produce similar results. It is, therefore, the desire of the applicant not to be bound by the description of this invention as contained in this specification, but to be bound only by the claims as appended hereto.

I claim:

1. A skeg cover for covering the skeg on a marine engine, comprising:

a sheet bent along its centerline to form a first wall and a second wall;

the first wall and the second wall oppose each other and are sealed along their adjacent edges to form an opening at the top;

a skid plate connected to one end of said first and second walls forming a pocket comprising the walls and the skid plate;

the skid plate including two sides and a rear-end, said sides being integrally and directly connected to the rear end and converging linearly forward from the rear end toward the centerline of the first and second walls immediately adjacent to the first and second walls; and at least one side terminating in a point on the centerline.

2. The apparatus according to claim 1 wherein the pocket formed is adapted to receive a bonding material for repairing a worn or broken lower unit housing of a marine engine or to reinforce and protect a new one.

3. The apparatus according to claim 1 wherein the skid plate strengthens the apparatus and functions as a hydro-deflector.

4. The skeg cover according to claim 1 wherein the two sides form acute angles with the rear end where they are integrally, directly connected, the acute angles and the rear end having the shape of a triangle.

* * * * *